US010480140B2

(12) United States Patent
Vigneault

(10) Patent No.: US 10,480,140 B2
(45) Date of Patent: Nov. 19, 2019

(54) SCRAPER BLADE DEVICE WITH JUXTAPOSED BLADE SEGMENTS HAVING A SWIVEL INTERCONNECTION BETWEEN MATING EDGES

(71) Applicant: Jimmy Vigneault, Plessiville (CA)

(72) Inventor: Jimmy Vigneault, Plessiville (CA)

( * ) Notice: Subject to any disclaimer, the term of this patent is extended or adjusted under 35 U.S.C. 154(b) by 37 days.

(21) Appl. No.: 15/486,275

(22) Filed: Apr. 12, 2017

(65) Prior Publication Data

US 2017/0218585 A1 Aug. 3, 2017

Related U.S. Application Data

(63) Continuation of application No. PCT/CA2015/051045, filed on Oct. 16, 2015.

(30) Foreign Application Priority Data

Oct. 17, 2014 (CA) ..... 2867957

(51) Int. Cl.
*E01H 5/06* (2006.01)
*E02F 9/22* (2006.01)
*E02F 9/28* (2006.01)

(52) U.S. Cl.
CPC ..... *E01H 5/062* (2013.01); *E01H 5/067* (2013.01); *E02F 9/2271* (2013.01); *E02F 9/2883* (2013.01)

(58) Field of Classification Search
None
See application file for complete search history.

(56) References Cited

U.S. PATENT DOCUMENTS

| | | | |
|---|---|---|---|
| 520,479 | A | 5/1894 | Bunnell |
| 1,383,409 | A | 7/1921 | Liddell |
| 2,055,291 | A | 9/1936 | Henry |
| 2,116,351 | A | 5/1938 | Jones |
| 2,337,434 | A | 12/1943 | Washbond |
| 2,697,289 | A | 12/1954 | Standfuss |
| 2,775,830 | A | 1/1957 | Kenyon |
| 2,962,821 | A | 12/1960 | Peitl |
| 3,014,289 | A | 12/1961 | Torrey |

(Continued)

FOREIGN PATENT DOCUMENTS

| | | | |
|---|---|---|---|
| CA | 2723630 | A1 | 6/2012 |
| CH | 313333 | A | 4/1956 |

(Continued)

OTHER PUBLICATIONS

Overview of RU2314384 with images (RU document published Jan. 10, 2008).

*Primary Examiner* — Tara Mayo-Pinnock
(74) *Attorney, Agent, or Firm* — Ipaxio S.E.N.C.

(57) ABSTRACT

The scraper blade device is provided for cleaning a roadway surface. The scraper blade device includes an upper blade portion and a bottom blade portion. The bottom blade portion has a plurality of widthwise-disposed and juxtaposed blade segments. The blade segments are provided in one or more blade segment sets where the blade segments within a same set are attached using a swivel interconnection. This scraper blade device has an improved cleaning efficiency over existing designs, thereby reducing the amount of de-icing chemicals and increasing road safety when used for removing ice and snow from the roadway surface.

19 Claims, 9 Drawing Sheets

(56) References Cited

U.S. PATENT DOCUMENTS

| | | | |
|---|---|---|---|
| 3,199,234 | A | 8/1965 | Reissinger |
| 3,231,991 | A | 2/1966 | Wandscheer et al. |
| 3,400,475 | A | 9/1968 | Peitl |
| 3,465,456 | A | 9/1969 | Meyer |
| 3,547,203 | A | 12/1970 | Jackoboice |
| 3,772,803 | A | 11/1973 | Cote |
| 3,808,714 | A | 5/1974 | Reissinger et al. |
| 4,031,966 | A | 6/1977 | Farrell |
| 4,249,323 | A | 2/1981 | Mathis et al. |
| 4,307,523 | A | 12/1981 | Reissinger et al. |
| 4,570,366 | A | 2/1986 | Yost |
| 4,597,202 | A | 7/1986 | Weeks |
| 4,669,205 | A | 6/1987 | Smathers |
| 5,140,763 | A | 8/1992 | Nichols |
| 5,191,729 | A | 3/1993 | Verseef |
| 5,344,254 | A | 9/1994 | Sartain |
| 5,437,113 | A | 8/1995 | Jones |
| 5,697,172 | A | 12/1997 | Verseef |
| 5,720,122 | A | 2/1998 | McLellan |
| 5,743,032 | A | 4/1998 | Vauhkonen |
| 5,819,443 | A | 10/1998 | Winter |
| 5,819,444 | A | 10/1998 | Desmarais |
| 5,899,007 | A | 5/1999 | Niemela et al. |
| 5,921,010 | A | 7/1999 | Schulte et al. |
| 6,035,944 | A | 3/2000 | Neuner et al. |
| 6,073,371 | A | 6/2000 | Goos et al. |
| 6,618,965 | B1 | 9/2003 | Schultz et al. |
| 6,701,646 | B2 | 3/2004 | Schultz et al. |
| 6,751,894 | B2 | 6/2004 | Verseef |
| 6,817,118 | B2 | 11/2004 | Schmeichel |
| 6,823,615 | B2 | 11/2004 | Strait |
| 6,892,480 | B1 | 5/2005 | Gledhill et al. |
| 7,100,311 | B2 | 9/2006 | Verseef |
| 7,100,314 | B1 | 9/2006 | Jensen |
| 7,107,709 | B2 | 9/2006 | Hamel |
| 7,134,227 | B2 | 11/2006 | Quenzi et al. |
| 7,171,770 | B2 | 2/2007 | Schultz et al. |
| 7,263,789 | B2 | 9/2007 | Hollinrake et al. |
| 7,467,485 | B2 | 12/2008 | Lachance et al. |
| 7,493,710 | B2 | 2/2009 | Frey et al. |
| 7,543,401 | B2 | 6/2009 | Hughes |
| 7,555,853 | B2 | 7/2009 | Paonessa |
| 7,631,441 | B2 | 12/2009 | Hunt |
| 7,658,022 | B2 | 2/2010 | Strait |
| 7,681,335 | B2 | 3/2010 | Schmeichel |
| 7,730,643 | B2 | 6/2010 | Mishra et al. |
| 7,743,536 | B2 | 6/2010 | Evans et al. |
| 7,841,109 | B2 | 11/2010 | Stevens et al. |
| 8,776,405 | B2 | 7/2014 | Paonessa |
| 9,051,700 | B2 | 6/2015 | Summers et al. |
| 9,200,418 | B2 | 12/2015 | Jones et al. |
| 9,611,604 | B2 | 4/2017 | Vigneault |
| 2003/0066738 | A1 | 4/2003 | Veenhof |
| 2013/0174452 | A1* | 7/2013 | Diehl ..... E01H 5/063 37/233 |
| 2015/0101216 | A1 | 4/2015 | Kerr et al. |

FOREIGN PATENT DOCUMENTS

| | | | |
|---|---|---|---|
| CH | 382207 | A | 9/1964 |
| CH | 678344 | A5 | 8/1991 |
| CN | 2903176 | U | 5/2007 |
| CN | 201866149 | U | 6/2011 |
| CN | 203346934 | U | 12/2013 |
| CN | 103498444 | A | 1/2014 |
| CN | 205100150 | U | 3/2016 |
| CN | 205387727 | U | 7/2016 |
| DE | 1299675 | B | 7/1969 |
| DE | 3608893 | A1 | 9/1987 |
| DE | 3711988 | A1 | 10/1988 |
| DE | 8811708 | U1 | 5/1989 |
| EP | 0849401 | B1 | 3/2002 |
| EP | 1247906 | A2 | 10/2002 |
| EP | 2154294 | A1 | 2/2010 |
| FR | 1050311 | A | 1/1954 |
| FR | 2179703 | A1 | 11/1973 |
| FR | 2269608 | A1 | 11/1975 |
| FR | 2349683 | A1 | 11/1977 |
| FR | 2448599 | A1 | 9/1980 |
| GB | 402584 | A | 12/1933 |
| GB | 766042 | A | 8/1952 |
| GB | 1015307 | A | 9/1954 |
| JP | 55061623 | A | 5/1980 |
| JP | 2005068908 | A | 3/2005 |
| JP | 6004904 | B2 | 10/2016 |
| KR | 200422656 | Y1 | 7/2006 |
| WO | 2010015992 | A2 | 2/2010 |
| WO | 2016058106 | A1 | 4/2016 |

* cited by examiner

SCRAPER BLADE DEVICE WITH JUXTAPOSED BLADE SEGMENTS HAVING A SWIVEL INTERCONNECTION BETWEEN MATING EDGES

CROSS-REFERENCE TO PRIOR APPLICATIONS

The present case is a continuation of PCT Application No. PCT/CA2015/051045 filed on 16 Oct. 2015. The present case claims the benefit of Canadian patent application No. 2,867,957 filed on 17 Oct. 2014. The entire contents of these prior patent applications are hereby incorporated by reference.

TECHNICAL FIELD

The technical field relates generally to scraper blade devices and methods of cleaning surfaces by removing undesirable materials from these surfaces.

TECHNICAL BACKGROUND

One example of a surface to be cleaned is a roadway surface on which accumulated some snow and/or ice (which are hereafter generically referred to in a non-limitative manner as "frozen water materials"). This is traditionally done using a rigid blade having a lowermost edge that is in engagement with the roadway surface. The blade is attached to a vehicle, for instance a truck or the like, travelling over the roadway surface. A blade is often relatively large so as to maximize the width of the surface cleaned in a single pass. Such concept, however, assumes that the roadway surface is perfectly smooth, flat and free of obstructions. In practice, roadway surfaces are not. For instance, the surface height profile often varies irregularly from one end of the lowermost edge of the blade to the other and the surface height profile varies all the time as the blade moves thereon. The lowermost edge is therefore not always fully in engagement with the roadway surface over its entire length, with the result that some frozen water materials tend to remain on the roadway surface at various locations, especially where the surface height is the lowest compared to the immediate surrounding areas. The efficiency of the cleaning is thus reduced.

Road maintenance operators must often use de-icing chemicals to melt the remaining frozen water materials so as to complete the cleaning. The amounts of de-icing chemicals are generally inversely proportional to efficiency of the cleaning. Thus, if the cleaning is inefficient, more de-icing chemicals are required. This has a direct impact on the operating costs and increases the footprint on the environment.

Different approaches have been suggested over the years for mitigating the difficulties experienced with fully-rigid snowplow blades. One approach is presented for instance in Swiss Patent No. 416,708 granted 15 Jul. 1966. This patent uses a series of spring-biased movable plates on the lowermost edge of the blade. Similar arrangements are disclosed for instance in U.S. Pat. No. 3,400,475 granted 10 Sep. 1968, in Canadian Patent No. 2,423,830 granted 10 Feb. 2004 and in U.S. Pat. No. 7,467,485 granted 23 Dec. 2008.

Another approach is to use a series of plates on the lowermost edge of the blade where the plates are resiliently attached to the rest of the blade. Examples are shown in U.S. Pat. No. 520,479 granted 29 May 1894 and in U.S. Pat. No. 5,743,032 granted 28 Apr. 1998.

Canadian Patent No. 2,796,157 issued on 13 Aug. 2013 to Jimmy Vigneault discloses a scraper blade device where ground-engaging blade segments are independently slidingly movable, in an up and down movement, out of alignment with reference to the bottom edge of the other blade segments so as to keep an optimized contact with the surface to be cleaned in spite of the various height variations across the width resulting from irregularities encountered on the surface as the scraper blade device moves thereon. The bottom edge of the blade segments can also be temporarily pivoted towards a tripped reclined position upon impact with an obstruction on the surface to be cleaned so as to mitigate damages to the blade segments and/or to the surface to be cleaned. Canadian Patent No. 2,796,157 is hereby incorporated by reference in its entirety.

In general, it is often desirable to minimize the total number of blade segments in a scraper blade device so as to lower the overall manufacturing costs and complexity. On the other hand, increasing the number of blade segments can increase the efficiency of the cleaning since using more adjacent blade segments across the width of the scraper blade device means that each blade segment will be narrower in width. Narrower blade segments can follow the irregularities on the surface more closely. However, increasing the number of blade segments will require additional components and/or labor. A compromise must be found between the desired efficiency and these factors.

There is always some room for further improvements in this area of technology and improvements in overall efficiency of the cleaning are particularly desirable.

SUMMARY

The present concept involves an approach where the scraper blade device includes one or more sets of juxtaposed blade segments where the blade segments have a swivel interconnection between them. The blade segments of each set are pivotally attached side-by-side using a positive arrangement capable of resisting detachment. However, the bottom edges of the blade segments within the same set can be tilted of a few degrees with reference to one another, thereby further increasing the freedom of movement of each blade segment with reference to all the other blade segments on the scraper blade device.

In one aspect, there is provided a scraper blade device for cleaning a roadway surface, the scraper blade device having a front plow surface and a lowermost edge, the scraper blade device including: an upper blade portion generally defining an upper area of the front plow surface of the scraper blade device; and a bottom blade portion generally defining a bottom area of the front plow surface of the scraper blade device, the bottom blade portion including a plurality of widthwise-disposed and juxtaposed blade segments, each blade segment including a bottom surface-engaging edge and the bottom surface-engaging edges of the blade segments forming together the lowermost edge of the scraper blade device, each blade segment being slidingly movable in an up and down movement relative to the upper blade portion, the blade segments of the bottom blade portion forming one or more blade segment sets, each blade segment set having at least two of the blade segments that are pivotally jointed at a corresponding swivel interconnection, whereby, in operation, the bottom surface-engaging edges of the blade segments in a same blade segment set can tilt with reference to one another when following profile variations of the roadway surface.

In another aspect, there is provided a scraper blade device for cleaning a surface when moving in a forward direction relative to the surface, the scraper blade device having a front surface and a lowermost edge, the scraper blade device including: an upper blade portion generally defining an upper area of the front surface of the scraper blade device; and a bottom blade portion generally defining a bottom area of the front surface of the scraper blade device, the bottom blade portion including a plurality of widthwise-disposed and juxtaposed blade segments, each blade segment including a bottom edge and the bottom edges of the blade segments forming together the lowermost edge of the scraper blade device, the bottom edge of each blade segment being slidingly movable in an up and down movement and can also be tilted out of alignment with reference to the bottom edges of the other blade segments, the blade segments being provided in one or more sets where the blade segments within a same set have a swivel interconnection between corresponding mating edges and are pivotally attached side-by-side using a positive arrangement capable of resisting detachment so that the blade segments within the same set can be secured but also tilted of a few degrees with reference to one another, thereby further increasing the freedom of movement of each blade segment with reference to all the other blade segments on the scraper blade device.

In another aspect, there is provided a scraper blade device as shown, described and/or suggested herein.

In another aspect, there is provided a method of cleaning a surface as shown, described and/or suggested herein.

Details on various aspects and features of the proposed concept will become apparent in light of the detailed description which follows and the appended figures.

DETAILED DESCRIPTION

Figure 1:
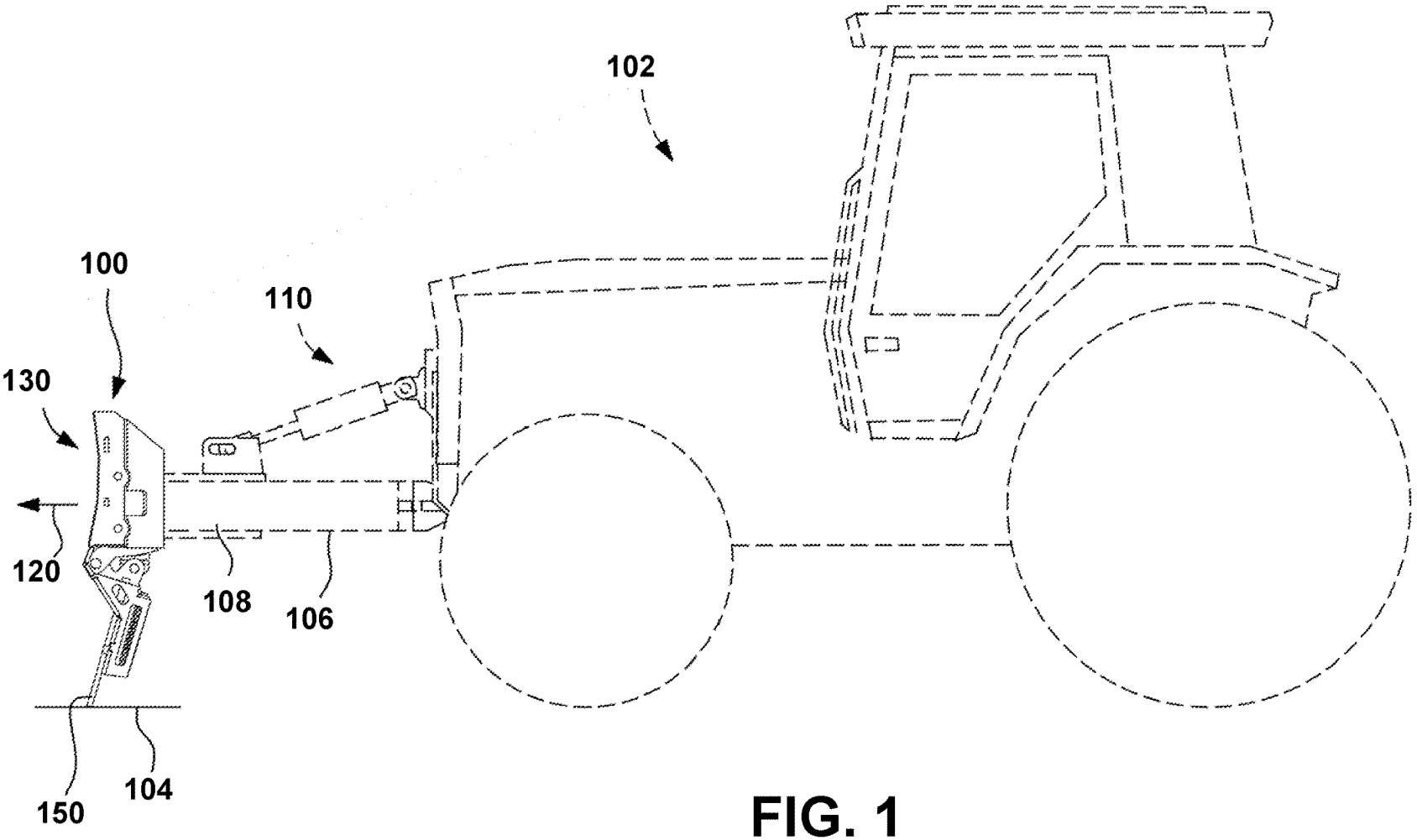
FIG. 1 is a side view of an example of a scraper blade device incorporating the proposed concept, the scraper blade device being shown as mounted in front of a generic vehicle for cleaning a roadway surface.

FIG. 1 is a front view of an example of a scraper blade device 100 incorporating the proposed concept. The scraper blade device 100 is shown as mounted in front of a generic vehicle 102 for cleaning a roadway surface 104. The model or kind of vehicle for use with the scraper blade device 100 can be different from the one being illustrated in FIG. 1. Likewise, although the scraper blade device 100 is shown as being mounted in front of the vehicle 102, it can also be mounted elsewhere, for instance laterally on the side of a vehicle, under a vehicle or even behind a vehicle.

Figure 2:
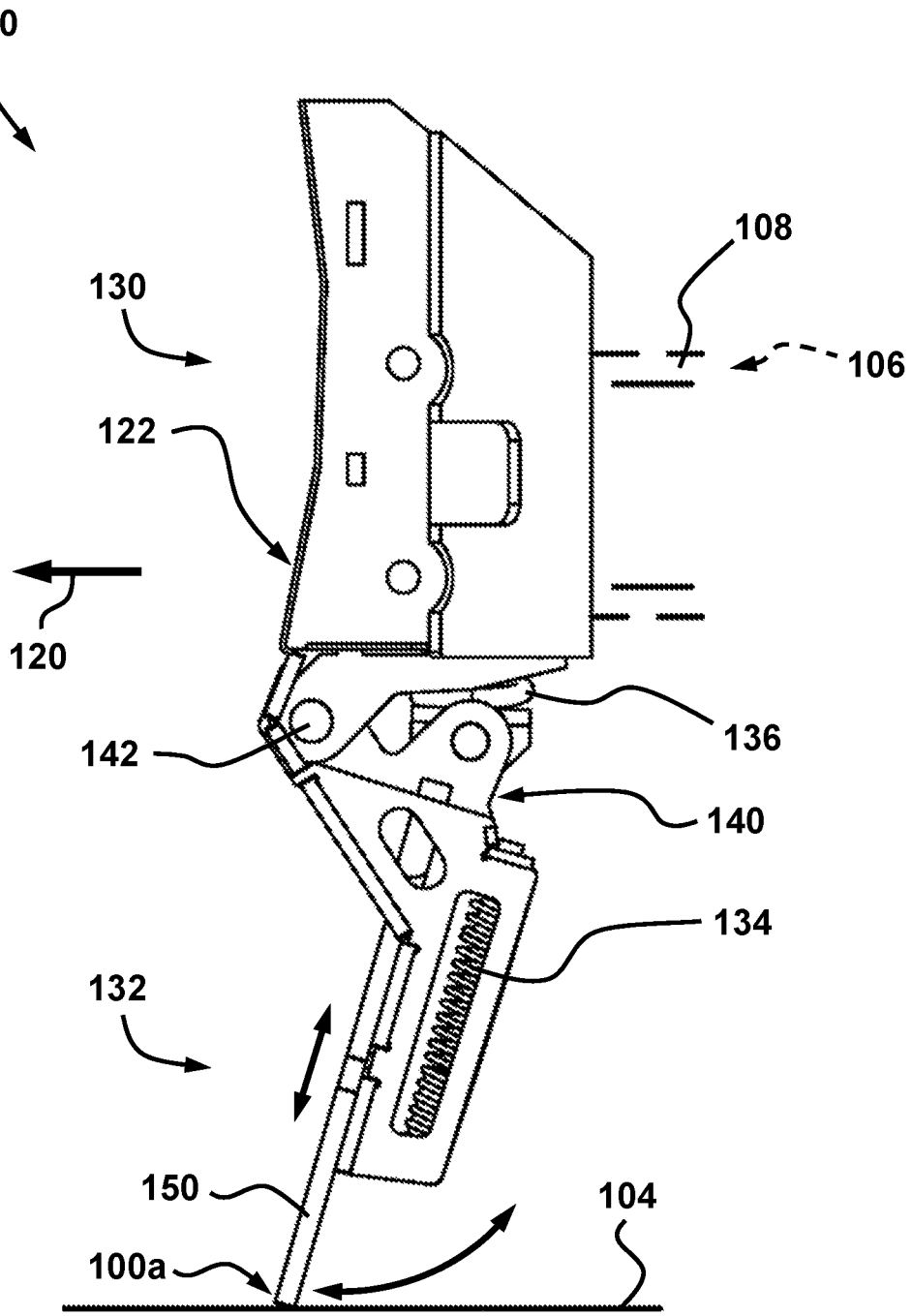
FIG. 2 is an enlarged side view of the scraper blade device shown in FIG. 1.

FIG. 2 is an enlarged side view of the scraper blade device 100 shown in FIG. 1.

The scraper blade device 100 illustrated in FIGS. 1 and 2 is primarily designed for removing frozen water materials from the roadway surface 104. However, one can use the scraper blade device 100 for removing other kinds of loose and/or adhering materials on a surface to clean. Examples include sand, rocks, gravel and earth, to name just a few. One can also clean a surface with the scraper blade device 100 without necessarily mounting it to a vehicle since the scraper blade device 100 can be used in many other applications. One example of another application is to clean the surface of a conveyor belt transporting one or more materials. For the sake of simplicity, the present description refers only to the example of the scraper blade device 100 for removing frozen water materials from the roadway surface 104 but it must be understood that the proposed concept is not necessarily limited to such context. Still, the exact overall shape and configuration of the scraper blade device 100 can vary from one implementation to another. It is not limited to the exact ones being shown in the figures.

The expression "roadway surface" is used herein in a generic manner and designates a surface to be cleaned by the scraper blade device 100. This can include, for instance, roadway surfaces made of different materials, for instance asphalt, concrete, stones, gravel, earth, etc. The roadway surfaces can be roads for vehicles, parkings, airport runways, sidewalks, etc. Other variants are possible as well. Depending on the kind of roadway surfaces to be cleaned, the scraper blade device 100 will often have an overall width between 1 m and 8 m. Nevertheless, other dimensions are also possible.

The scraper blade device 100 of FIGS. 1 and 2 is configured for cleaning roadway surfaces at a relatively slow speed, such as for cleaning parkings or roadways in residential areas. A scraper blade device for cleaning highways or the like would generally be shaped with a curved upper portion. Variants are possible as well.

The illustrated scraper blade device 100 is connected to the vehicle 102 using a generic connection assembly 106. The illustrated generic connection assembly 106 has a frame 108 and includes an actuator, for instance a hydraulic actuator 110, for lifting and lowering the lowermost edge 100*a* (FIG. 2) of the scraper blade device 100 with reference to the roadway surface 104. The hydraulic actuator 110 can also control the contact pressure between the lowermost edge 100*a* and the roadway surface 104 by supporting or not a part of the weight of the scraper blade device 100 in use. Some implementations may include skids underneath the scraper blade device 100. These skids can engage the roadway surface 104 to support at least a part of the weight during operation. Other arrangements and variants are possible as well.

Removing frozen water materials from the roadway surface 104 is generally done as the scraper blade device 100 has its lowermost edge 100*a* in engagement with the roadway surface 104 and as the vehicle 102 moves, in this case in a forward direction, so as to propel the scraper blade device 100 and push the frozen water materials accumulating in front of the scraper blade device 100. The forward direction is shown in FIG. 1 and at 120. The scraper blade device 100 has a front plow surface 122.

In some implementations, the scraper blade device 100 can allow the frozen water materials to be ejected laterally as the scraper blade device 100 travels in the forward direction 120. The forward travel direction 120 is thus not necessarily always perpendicular to the blade device 100 and it can define an angle therewith. The frozen water materials can be discharged at one or both ends thereof as the vehicle 102 pushes the scraper blade device 100. The scraper blade device 100 can even be articulated, for instance with a vertical hinge at the center, to obtain many possible configurations. Variants are possible as well.

In other cases, the frozen water materials accumulating on the front plow surface 122 can simply be pushed over some distance while remaining in front of the scraper blade device 100 before the vehicle 102 backs up and leaves them where they are. Variants are possible as well.

Some cleaning can also be achieved when moving the scraping blade device 100 in a rearward travel direction but most of the time, the cleaning is done as the vehicle 102 travels in the forward travel direction 120. If the scraper blade device 100 is located at the rear of the vehicle 102, it will be in an inverted position. The front plow surface 122 of such scraper blade device 100 would be facing the rear side of the vehicle 102 and most of the cleaning would thus be done as the vehicle 102 moves backwards. For the sake of simplicity, reference will only be made to the forward travel direction as being the normal direction to achieve cleaning with the scraper blade device 100, being understood that this forward travel direction may sometimes not correspond to the forward travel direction of a given vehicle, as a person skilled in the art will readily understand.

The illustrated scraper blade device 100 includes an upper blade portion 130 and a bottom blade portion 132 extending widthwise on the scraper blade device 100. The upper blade portion 130 generally defines an upper area of the front plow surface 122. Likewise, the bottom blade portion 132 generally defines a bottom area of the front plow surface 122. The frame 108 of the illustrated generic connection assembly 106 is attached at the rear of the upper blade portion 130. Variants are also possible.

It should be noted that the scraper blade device 100 can also include one or two wing plates or extensions to facilitate the handling of the frozen water materials. Wing plates can be fixed or be adjustable in position by the operator even during operation. An example of an adjustable wing plate is one where the wing plate is pivotally mounted at a corresponding end of the upper blade portion 130 and can pivot around a substantially vertical axis. The position of the wing plate can be set remotely by the operator, for instance using an actuator such as a hydraulic actuator, or using another suitable mechanical device. Some wing plate arrangements are designed to move the wing plate over 180°. Variants are possible as well.

The upper blade portion 130 can be made of one or more juxtaposed rigid panels configured and disposed so as to form a continuous front surface area. A plurality of reinforcing members can be provided at the rear to reinforce the upper blade portion 130. In the illustrated example, the upper blade portion 130 forms a rigid structure. It can be made using a material such as steel. Other materials and configurations are possible as well.

Figure 3:
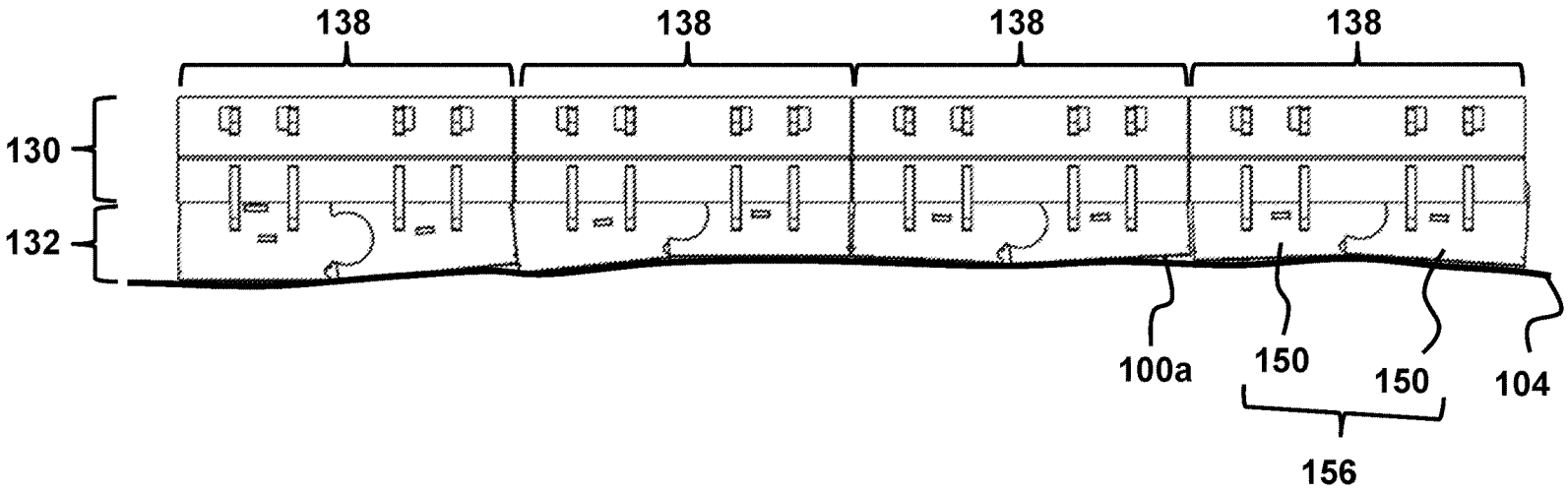
FIG. 3 is a front view of the scraper blade device shown in FIG. 1.

FIG. 3 is a front view of the scraper blade device 100 shown in FIG. 1. As can be seen, this scraper blade device 100 includes a plurality of juxtaposed moldboard sections 138. The moldboard sections 138 were independently constructed and were later attached side-by-side to form a single unit. Each moldboard section 138 includes a part of the upper blade portion 130 and a part of the bottom blade portion 132. Four identical moldboard sections 138 are provided in the illustrated example but variants are possible. The sectionized construction allows to create scraper blade devices of various widths by varying the number of moldboard sections 138. Nevertheless, one can design scraper blade devices differently, for instance with at least one of the moldboard sections being different from the others or without using juxtaposed moldboard sections. Other variants are also possible.

The bottom blade portion 132 includes a plurality of widthwise-disposed and juxtaposed blade segments 150. The widthwise direction corresponds to the direction along which the scraper blade device 100 extends. Each blade segment 150 includes a bottom surface-engaging edge **150*a* that will slide on the roadway surface 104 when the scraper blade device 100 is lowered to a ground-engaging position and propelled by the vehicle 102**.

The bottom surface-engaging edges **150*a* of the blade segments 150 form together the lowermost edge 100*a* of the scraper blade device 100 and in many implementations, they will all be substantially parallel and coplanar. As can be seen in FIGS. 1 and 2, the blade segments 150** can be slanted towards the rear with reference to the vertical.

The blade segments 150 form one or more sets of blade segments 150. There is at least one blade segment set 156 in each scraper blade device 100, often more than one. The illustrated scraper blade device 100 includes four blade segment sets 156, each having two blade segments 150. There is also one blade segment set 156 for each moldboard section 138 in the illustrated example. Variants are possible as well.

In each blade segment set 156, the blade segments 150 that are part of the set are pivotally jointed by a corresponding swivel interconnection 160. The swivel interconnection 160 allows the bottom edges **150*a* of the blade segments 150 in a same blade segment set 156 to tilt (i.e. to move out of horizontal alignment) with reference to one another. This way, the scraper blade device 100 can better follow the height variation profile of the roadway surface 104. The interconnected blade segments 150** remain essentially parallel and often coplanar with tilted with reference to one another.

The blade segments 150 are also slidingly movable in an up and down movement. This motion is essentially linear. The blade segments 150 are guided by a guiding arrangement but this guiding arrangement is not preventing them from tilting. This can be achieved, for instance by loosely or pivotally mounting the blade segments 150 on the mechanical connector attaching them to the guiding arrangement. The connector is constrained to the up and down path but each blade segment 150 is capable of pivoting about its connector. Examples of guiding arrangements are shown in Canadian Patent No. 2,796,157 issued on 13 Aug. 2013 to Jimmy Vigneault. As aforesaid, this patent is hereby incorporated by reference in its entirety. The guiding arrangement can include slots made in support frame members 140.

In use, the blade segments 150 are movable between a downward extended position and an upward retracted position. The blade segments 150 are biased towards the downward extended position using a plurality of first bias mechanisms 134. Each first bias mechanism 134 can include, for instance, one or more helical springs, as shown in FIG. 2, that is mounted behind the blade segments 150. Other kinds of bias mechanisms can be used as well, including ones where no mechanical springs are used, such as pneumatic actuators, hydraulic actuators and others. Still, the first bias mechanisms 134 can be provided elsewhere than at the rear of the blade segments 150 in some implementations. Other variants are possible as well.

In the illustrated example, each blade segment 150 is supported by a corresponding support frame member 140 and can slide thereon while being guided by a corresponding underlying slot and its associated follower. There is one support frame member 140 for each blade segment set 156, thus one for each moldboard section 138 in the example. Variants are possible as well. The support frame member 140 includes vertically-extending slots providing the guiding arrangements for the blade segments 150. The support frame members 140 further hold the corresponding first bias mechanisms 134. Variants are possible as well.

Each blade segment 150 will generally have a substantially rectangular shape and a width that is between about 50 cm up to a few meters. Nevertheless, in some implementations, other shapes and/or widths can be provided. The blade segments 150 can be made of different materials, for instances steel, stainless steel or a polymer, to name just a few. In some applications, some of the blade segments 150 can be made at least in part of a resilient material, such as rubber or the like, instead of an entirely rigid material.

The bottom area of the front plow surface 122 of the illustrated scraper blade device 100 is formed by the exposed front surfaces of the support frame members 140 and the exposed front surfaces of the blade segments 150. Also, because adjacent blade segments 150 are all relatively close to one another along the entire width of the scraper blade device 100, the front plow surface 122 of the scraper blade device 100 can be considered as being uninterrupted from one side to another. Thus, no significant amount of frozen water material can pass between two adjacent blade segments 150.

The scraper blade device 100 is designed reacts to a localized unevenness on the roadway surface 104. As aforesaid, roadway surfaces are generally not always perfectly smooth, flat and free of obstructions. The height of a roadway surface often varies irregularly in a transversal direction, thus from one end of the lowermost edge 100*a* of the scraper blade device 100 to the other, and also continuously as the scraper blade device 100 is pushed in the forward travel direction 120. The up and down movement capability of the blade segments 150 provides a way of keeping the scraper blade device 100 in an optimized contact with the roadway surface 104 in spite of the continuous height variations across its width. The waviness, the undulations, the buckled zones and all other usual non-abrupt defects or transitions on the roadway surface 104 that do not significantly interfere with (i.e. impede) the sliding movement of the lowermost edge 100*a* of the scraper blade device 100 thereon are referred to as "irregularities".

Providing a swivel interconnection 160 between blade segments 150 where their bottom edges can be tilted can create a lowermost edge 100*a* that is somewhat "articulated", namely that can more closely follow the shape of the roadway surface 104. This is visible in FIG. 3. As can be seen, the profile of the roadway surface 104 is a continuous succession of irregular curves but the scraper blade device 100 adapted to this wavy shape. This is done on a continuous basis when the scraper blade device 100 is pushed in the forward travel direction 120 on the roadway surface 104.

Figure 4:
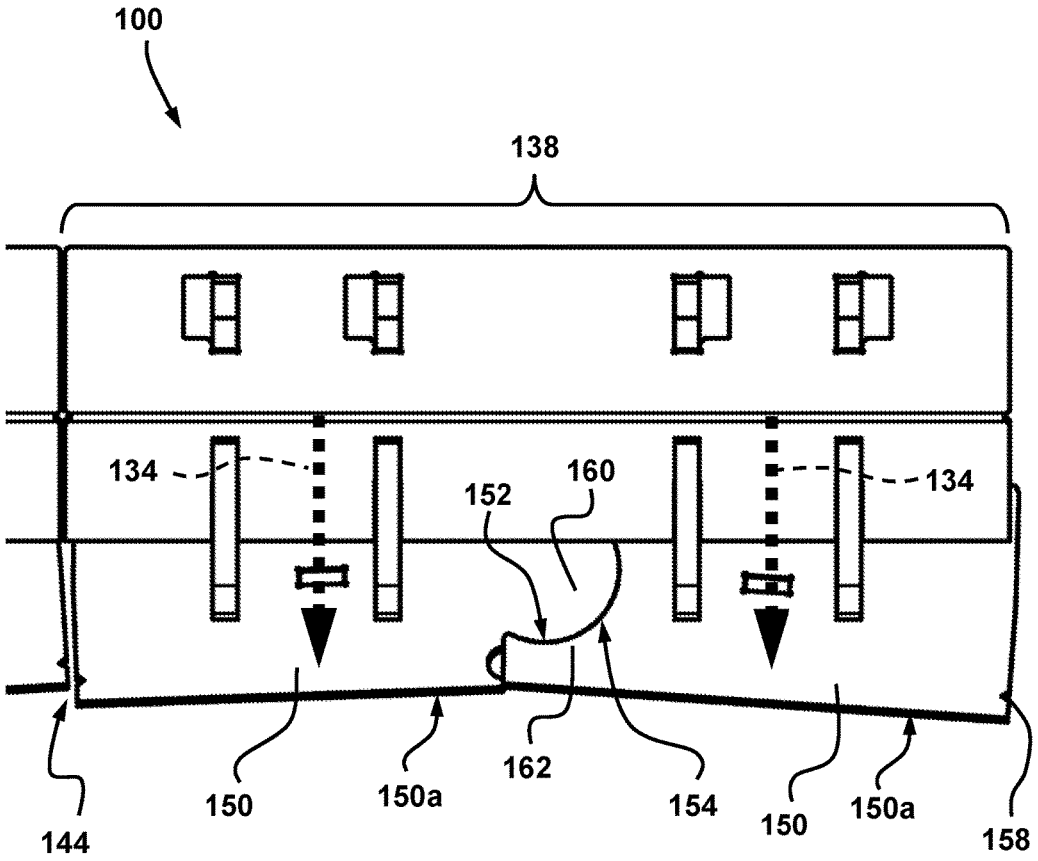
FIG. 4 is an enlarged front view of one of the blade segments of the scraper blade device shown in FIG. 1.
Figure 5:
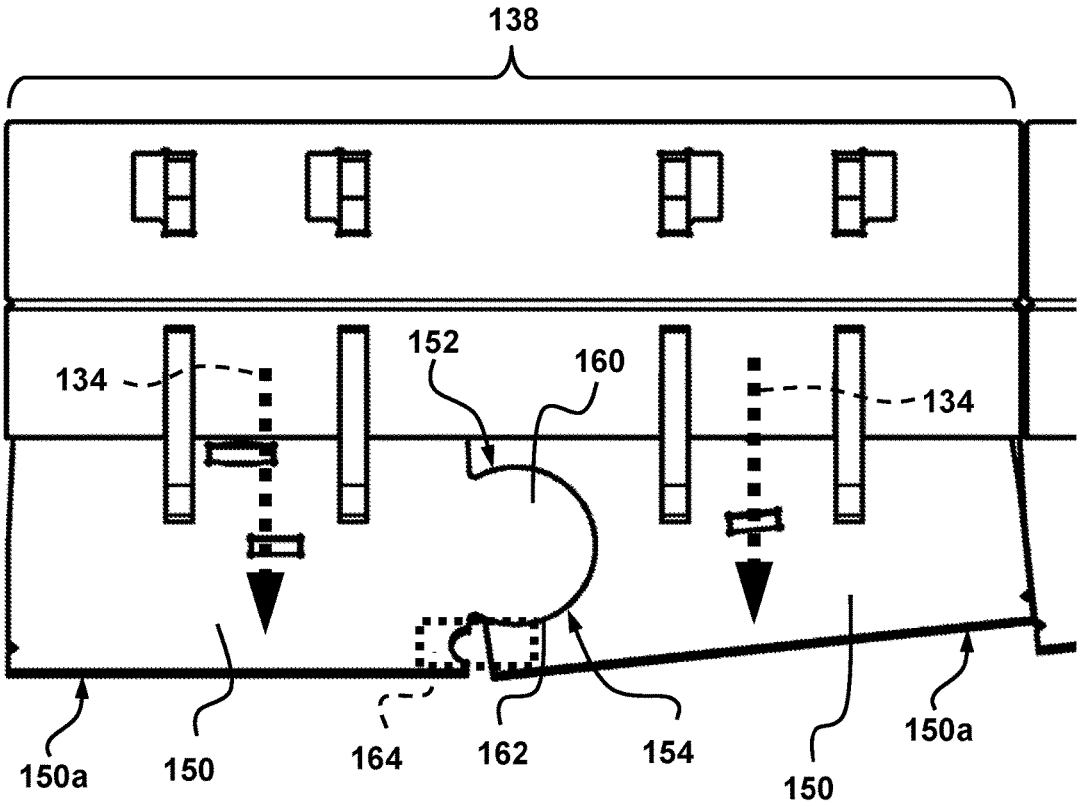
FIG. 5 is a view similar to FIG. 4, illustrating another one of the blade segments of the scraper blade device shown in FIG. 1.

FIG. 4 is an enlarged front view of one of the support frame members 140 of the scraper blade device 100 shown in FIG. 1. FIG. 5 is a view similar to FIG. 4, illustrating another one of the support frame members 140 of the scraper blade device 100 shown in FIG. 1.

As can be seen, the swivel interconnection 160 in the illustrated example includes male and female complementary parts. The male part is a rounded part that is laterally projecting from one of the blade segments 150. The rounded part is secured inside a complementary lateral opening 162 provided on the adjacent blade segment 150, the opening 162 forming the female part. This arrangement secures the mating edges 152, 154 of these blade segments 150. The various parts are sized so that the maximum tilting angle is generally maintained lower than an angle where adjacent blade segments 150 of two different sets could interfere with one another. Variants are possible as well.

The mating edges 152, 154 are in engagement with one another around the rounded part but there is an increased spacing elsewhere, for at the bottom. The bottom gap will provide the spacing for tilting the blade segments 150 over at least a few degrees in both directions. The complementary parts forming each swivel interconnection 160 preferably have smooth mating surfaces and it is often desirable to avoid arrangements where grease or other added lubricants are required since they are prone to retain foreign matters such as sand, dirt and de-icing salt. Nevertheless, lubricants may still be used in some implementations.

In FIGS. 4 and 5, the action of the springs 134 pushing the blade segments 150 downwards is schematically depicted by arrows. These two figures also illustrate two examples of relative orientations of the blade segments 150. As can be seen in FIG. 4, at the lower left corner of the view, adjacent moldboard sections 138 are configured and disposed so as to provide a marginal spacing 144 between the adjacent ones of their blade segments 150. The marginal spacing 144 will prevent the adjacently-disposed blade segments 150 of two different moldboard sections 138 from interfering with one another, at least within at least part of the range of angles. Nevertheless, in some instances, the lateral side edges of two adjacent blade segments 150 may engage one another, as depicted in FIG. 5 (lower right corner of the view). This can also be a way to limit the range of angles.

If desired, the scraper blade device 100 can include a reclining capability in order to avoid damages and costly repairs due to an impact with an obstruction. An obstruction can be generally defined as something unusual on the roadway surface 104 that cannot be compensated by only sliding one or more of the blade segments 150 thereon. It can be for instance a sudden change in height of the roadway surface 104 or a foreign object. Examples include an abrupt crack in the pavement, a protruding rim of a manhole and an exposed rock, to name just a few. Frozen ice accumulations adhering on the roadway surface 104 can also sometimes create obstructions. An obstruction can be impacted by the scraper blade device 100 if the operator deviated from the desired path. For instance, curbs can be difficult to locate when they are covered by snow and are often hit during a snow cleaning operation. The impact of the scraper blade device 100 with an obstruction is one that can cause damages when the stress due to the impact exceeds a certain limit. Hitting an obstruction can potentially cause a failure and force an operator to immediately stop an ongoing cleaning operation.

In the illustrated example, each support frame member 140 is capable of independently pivoting in case of an impact of one of the blade segments 150 with the obstruction and immediately get back in position once the obstruction is cleared. This mitigates the damages to the scraper blade device 100. Each of these support frame members 140 is pivotally connected to the upper blade portion 130 and can pivot around a pivot axis 142 (FIG. 2) in case of an impact with an obstruction. The pivot axis 142 is substantially parallel to the lowermost edge 100*a* of the scraper blade device 100. This pivot axis 142 is located at the rear of the front plow surface 122. The support frame members 140 are independently pivotable between a forward working position and a tripped position. The support frame members 140 are spring loaded toward their forward working position using at least one second bias mechanism 136. FIG. 2 shows an example where the second bias mechanism 136 includes an helical spring 136, preferably a plurality thereof, each keeping the corresponding support frame member 140 in its forward wording position. Variants are possible as well.

It should be noted that in some implementations, the reclining evasive action can be done by pivoting a larger section or even all blade segments 150 backwards together, either by having all support frame members 140 attached together or constructed as a single unit, or by coupling the whole scraper blade device 100 to a pivot provided at the distal end of the frame 108. Other designs are possible as well.

In the illustrated example, if an obstruction only hit by one blade segment 150 of the scraper blade device 100, the other support frame members 140 will not be affected and the other blade segment sets 156 can remain in position during the collision. Only the blade segments 150 of the affected blade segment set 156 will recline backwards to pass over the obstruction. The pivot angle will depend on the relative height of the obstruction and the travel speed but as soon as the obstruction is cleared, the support frame member 140 will return back to its normal working position.

Also shown in FIG. 4 are wear indicators 158 provided on the blade segments 150. These wear indicators 158 are in the form of notches machined on a lateral side edge of the blade segments 150. The material at the bottom surface-engaging edge 150*a* of the blade segments 150 will wear off over time and as a result, the height of the blade segments 150 will become progressively smaller. The bottom surface-engaging edge 150*a* will eventually be in alignment with the wear indicators 158 and this will inform the operator and/or the mechanics that the blade segments 150 must be replaced by new ones. It should be noted that other wear indicator arrangements are also possible and wear indicators can even be entirely omitted in some implementations.

FIG. 5 schematically shows a cover plate 164 located near the bottom surface-engaging edge 150*a* of the blade segments 150. This cover plate 164 can be rectangular in shape and is rigidly attached to only one of the two blade segments 150. For instance, one of its ends can be welded or otherwise fastened to the corresponding blade segment 150. The cover plate 164 is positioned and disposed to overlap the bottom gap between two adjacent blade segments 150 but since it is only attached to one of the blade segments 150, it will interfere with the tilting movements of the blade segments 150. The cover plate 164 closes the bottom gap to minimize the amount of material that can eventually pass therein. It can also be useful to prevent material from accumulating inside the bottom gap under certain conditions and interfere with the normal pivot movements between the blade segments 150 in operation. Cover plates such as the one shown at 164 can be provided in front of all other bottom gaps of the scraper blade device 100. Variants in the shape, the disposition and the configuration of the cover plates are possible as well. Cover plates can also be entirely omitted in some implementations.

Figure 6:
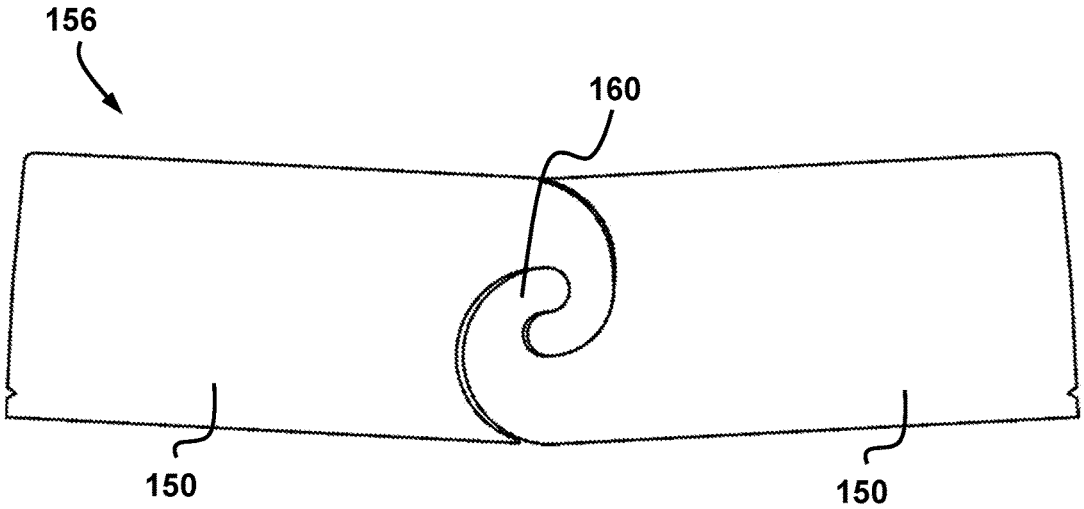
FIG. 6 is a front view of another example of a blade segment set with two blade segments.

FIG. 6 is a front view of another example of a blade segment set 156 with two blade segments 150. The shape of the complementary parts of the swivel interconnection 160 and the tolerances were chosen so that the lateral side edges of these adjacent blade segments 150 can tilt with reference to one another over at least a few degrees in both directions. Interestingly, there is no intervening bottom gap between the blade segments 150, regardless of the tilting angle.

If desired, more than two blade segments 150 can be provided in each set. Thus, one or more of the blade segments 150 will have a swivel interconnection 160 on both lateral sides, namely with the two immediately adjacent blade segments 150. This is shown for instance in FIGS. 7 to 11. FIGS. 7 to 10 are front views of examples of blade segment sets 156 having more than two blade segments 150. FIG. 11 is a top view of the blade segment set 156 shown in FIG. 10.

Figure 7:
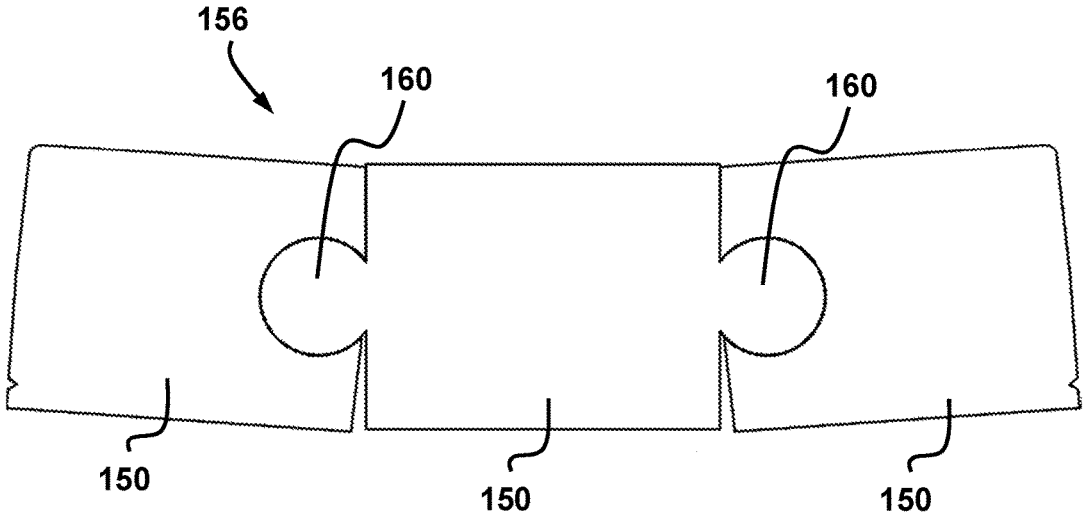
FIGS. 7 to 10 are front views of examples of blade segment sets having more than two blade segments.

In FIG. 7, the illustrated blade segment set 156 has three blade segments 150 and the blade segment 150 at the center has to opposite projecting portions to which the blade segments 150 on each side are jointed. The mating edges are designed so that the blade segments 150 can tilt of at least a few degrees in each direction. Variants are possible.

Figure 8:
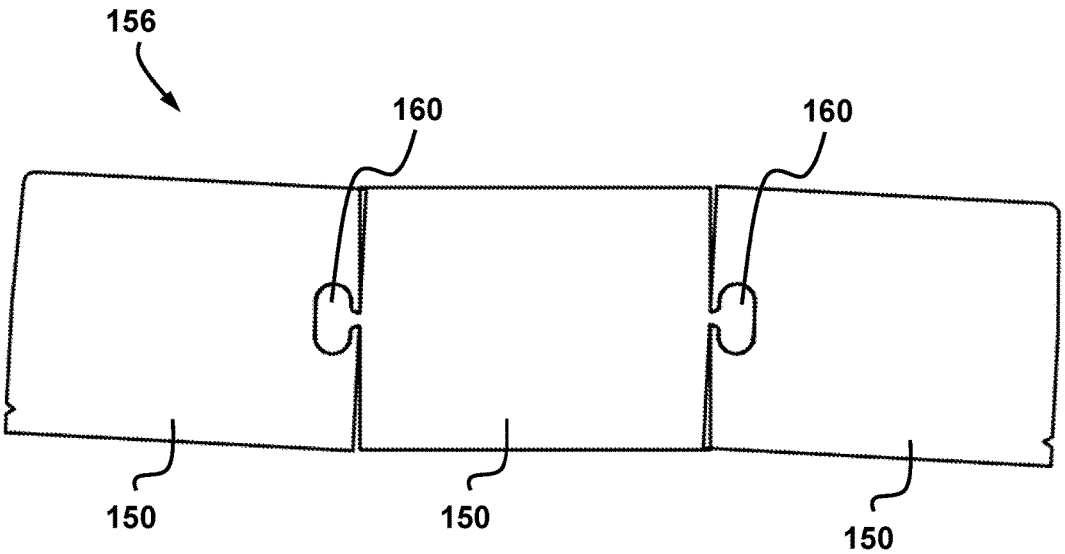

In FIG. 8, the illustrated blade segment set 156 is somewhat similar to that of FIG. 7 but the complementary parts forming the swivel interconnections 160 on each side of the central blade segment 150 are smaller. The shape of the complementary parts of the swivel interconnections 160 and the tolerances are designed so that the lateral side edges of the adjacent blade segments 150 can pivot with reference to one another over at least a few degrees in both directions.

Figure 9:
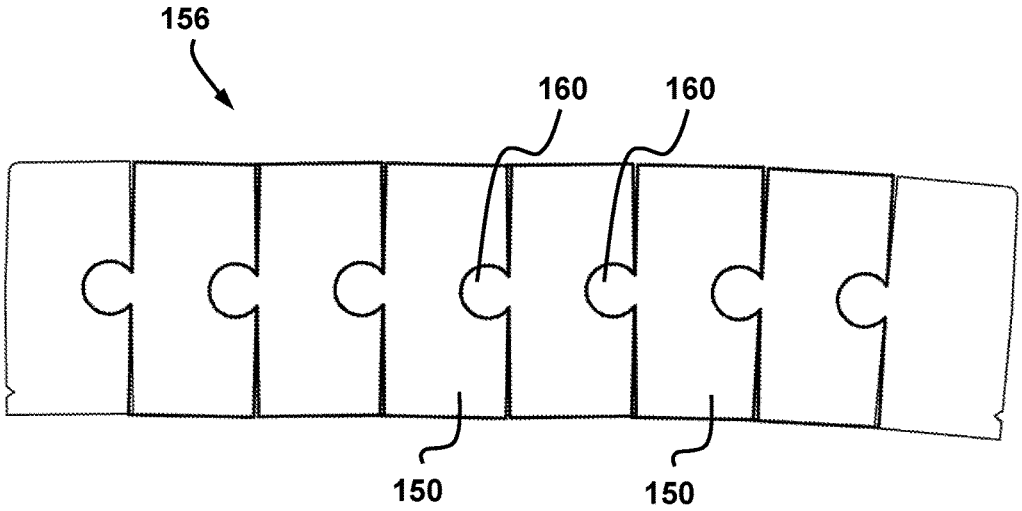

In FIG. 9, the illustrated blade segment set 156 includes more than three blade segments 150. The multitude of blade segments 150 forms a long chain of interconnected parts. This example also shows that in some implementations, the bottom surface-engaging edge 150*a* of the blade segments 150 can be the shorter side thereof. Nevertheless, one can also design a blade segment set 156 having a multitude of interconnected blade segments 150 where the bottom surface-engaging edge 150*a* is the longer side thereof.

Figure 10:
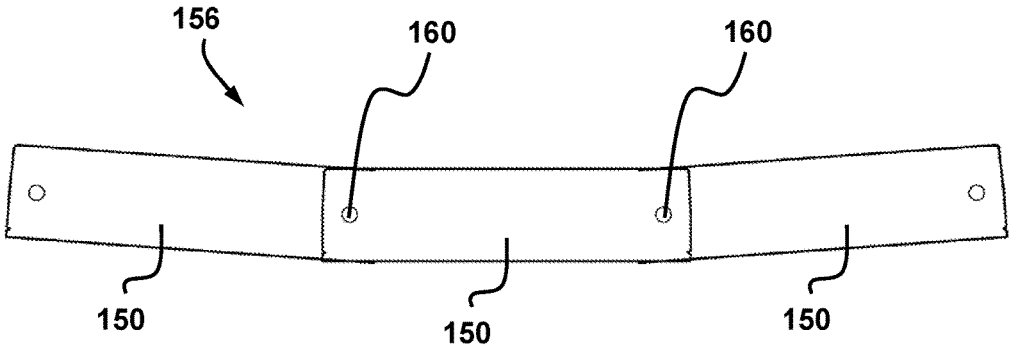
Figure 11:
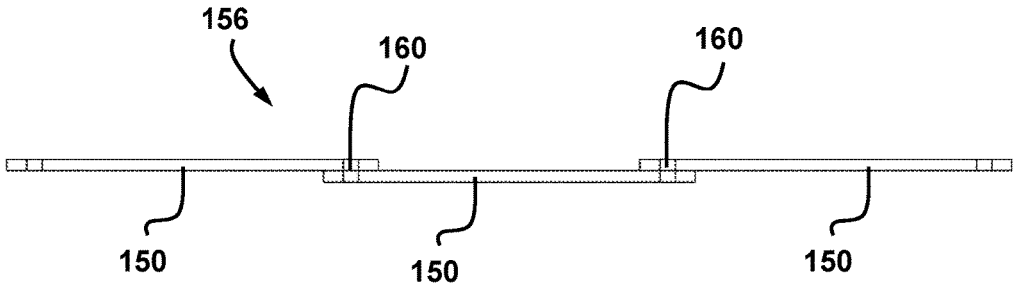
FIG. 11 is a top view of the blade segment set shown in FIG. 10.

In FIG. 10, the blade segments 150 have ends overlapping one another where the swivel interconnections 160 are provided. The blade segments 150 are not all coplanar but in this example, they nevertheless remain parallel to one another regardless of the tilting angle. The swivel interconnections 160 includes rods for jointing the adjacent blade segments 150, as best shown in FIG. 11.

Figure 12:
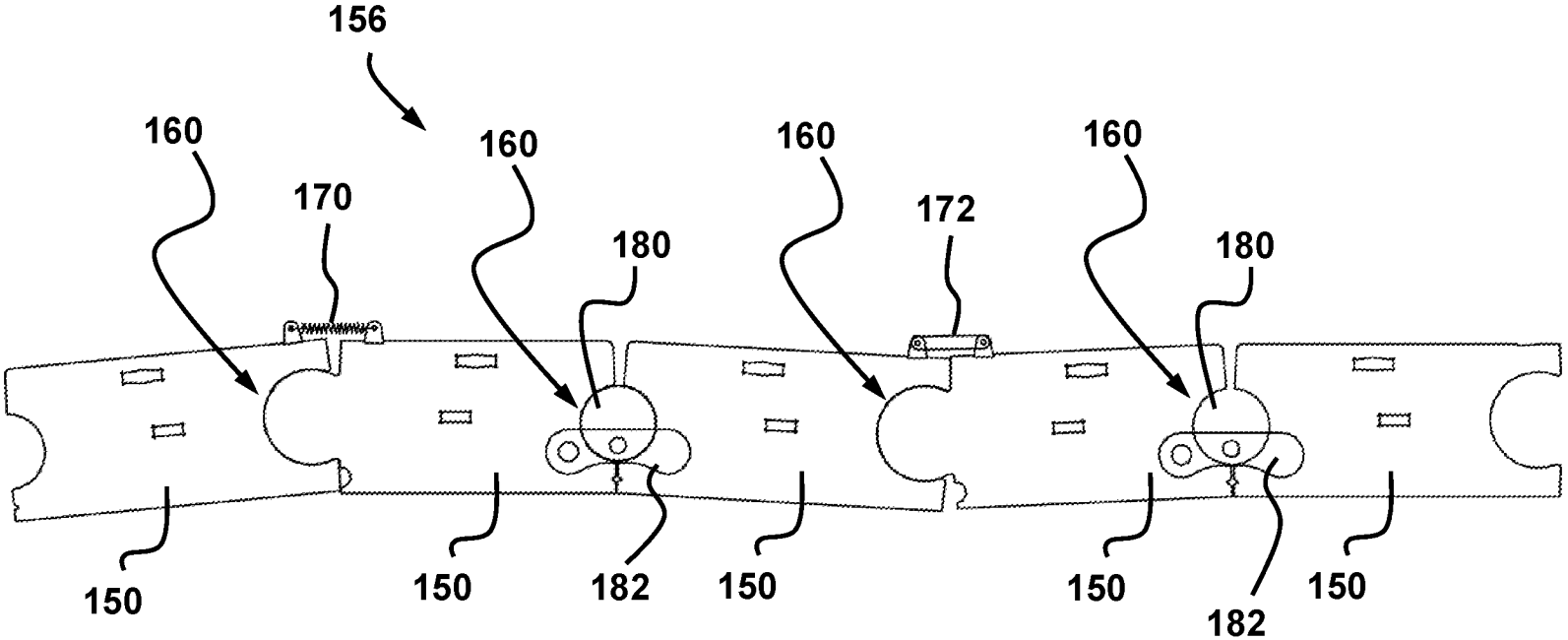
FIG. 12 is a front view of another example of a blade segment set.

FIG. 12 is a front view of another example of a blade segment set 156. Only some of the blade segments 150 of this set is shown. This figure also shows that one can provide elastic means over some of the adjacent blade segments 150 to urge them closer to one another. Two examples are shown, one where the elastic means linking the upper parts of two adjacent blade segments 150 includes an helical tension spring 170 and one where the elastic means linking the upper parts of two adjacent blade segments 150 includes an elastic rod 172, such as one made of a urethane material or the like. Other kinds of elastic means are possible as well. One can provide elastic means 170, 172 between all adjacent blade segments 150 and/or use the same kind of elastic means everywhere.

FIG. 12 further shows that some of the swivel interconnections 160 include a disc 180 located between the lateral side edges of corresponding blade segments 150. Holding plates 182 are all provided on both sides (front and rear) to keep the disc 180 in position. The holding plates 182 are each attached to only one of the adjacent blade segments 150. The guiding arrangement for the blade segments 150 keeps them in position so in this case. The swivel interconnections 160 with the discs 180 cannot resist lateral detachment but this kind of swivel interconnection is simpler to manufacture and may be suitable for some implementations.

It should be noted that when wing plates or extensions are used, one can provide blade segments 150 in accordance with the proposed concept on at least one of the wing plates or extensions, or even both. Each wing plate or extension, in such context, can be considered as a distinct scraper blade device 100, even when they are mounted on a larger one that already incorporates the proposed concept.

Overall, the proposed concept provides a way to further increase the efficiency of the cleaning compared to existing designs. This yields several advantages, including for instance reducing the amount of de-icing chemicals, increasing road safety, etc. The proposed concept can also provide other advantages, including: an improved mechanical strength, a facilitated maintenance in case of a failure of a part, the possibility of using the scraper blade device even in case of a partial failure, an increased travel speed while in use, an increased overall fuel efficiency, a reduction of the damages and wear to the roadway surfaces, a reduction of the amounts of de-icing chemicals released in the environment and a maintenance cost reduction for the operators.

The scraper blade device 100 can be made using a manufacturing process that includes any one of the following acts or combinations thereof: cutting, bending, punching, welding, bolting, gluing, painting.

The present detailed description and appended figures are only examples. A person working in this field will be able to see that variations can be made while still staying within the framework of the proposed concept.

LIST OF REFERENCE NUMERALS

100 scraper blade device
100*a* lowermost edge (of scraper blade device)
102 vehicle
104 roadway surface (surface to be cleaned)
106 connection assembly
108 frame
110 hydraulic actuator
120 forward direction
122 front plow surface (of scraper blade device)
130 upper blade portion
132 bottom blade portion
134 helical spring (first bias mechanism)
136 helical spring (second bias mechanism)
138 moldboard section
140 support frame member
142 pivot axis
144 marginal spacing
150 blade segment
150*a* bottom surface-engaging edge
152 mating edge
154 mating edge
156 blade segment set
158 wear indicator
160 swivel interconnection
162 lateral opening
164 cover plate
170 spring
172 elastic rod
180 linking disc
182 holding plate

What is claimed is:

1. A scraper blade device for cleaning a roadway surface, the scraper blade device having a front plow surface and a lowermost edge, the scraper blade device including:

an upper blade portion generally defining an upper area of the front plow surface of the scraper blade device; and a bottom blade portion generally defining a bottom area of the front plow surface of the scraper blade device, the bottom blade portion including a plurality of widthwise-disposed and juxtaposed blade segments, each blade segment including a bottom surface-engaging edge and the bottom surface-engaging edges of the blade segments forming together the lowermost edge of the scraper blade device, each blade segment being slidingly movable in an up and down movement relative to the upper blade portion, the blade segments of the bottom blade portion forming one or more blade segment sets, each blade segment set having at least two of the blade segments that are pivotally jointed at a corresponding swivel interconnection located between corresponding lateral sides of the blade segments, whereby, in operation, the bottom surface-engaging edges of the blade segments in a same blade segment set can tilt with reference to one another when following profile variations of the roadway surface, the swivel interconnection including a pin coupling overlapping ends of two adjacent blade segments among the blade segments.

2. The scraper blade device as defined in claim 1, wherein the swivel interconnection includes male and female complementary parts located on corresponding lateral side edges of the blade segments.

3. The scraper blade device as defined in claim 1, wherein the blade segment set, or at least one of the blade segment sets, includes more than two interconnected blade segments among the blade segments.

4. The scraper blade device as defined in claim 1, wherein the blade segments of a same blade segment set are parallel to one another.

5. The scraper blade device as defined in claim 1, wherein the blade segments of a same blade segment set are coplanar to one another.

6. The scraper blade device as defined in claim 1, wherein each blade segment is movable between a downward extended position and an upward retracted position, the blade segments being biased towards the downward extended position by a plurality of first bias mechanisms.

7. The scraper blade device as defined in claim 6, wherein each first bias mechanism includes an helical spring having one end attached to a corresponding one of the blade segments.

8. The scraper blade device as defined in claim 6, wherein each first bias mechanism is associated with only one of the blade segments.

9. The scraper blade device as defined in claim 1, wherein each blade segment is slidingly attached to a corresponding support frame member.

10. The scraper blade device as defined in claim 1, wherein the scraper blade device includes at least one of the following features:

the scraper blade device is mounted on a wing plate;

the scraper blade device is mounted on an extension.

11. A scraper blade device for cleaning a roadway surface, the scraper blade device having a front plow surface and a lowermost edge, the scraper blade device including:

an upper blade portion generally defining an upper area of the front plow surface of the scraper blade device; and a bottom blade portion generally defining a bottom area of the front plow surface of the scraper blade device, the bottom blade portion including a plurality of widthwise-disposed and juxtaposed blade segments, each blade segment including a bottom surface-engaging edge and the bottom surface-engaging edges of the blade segments forming together the lowermost edge of the scraper blade device, each blade segment being slidingly movable in an up and down movement relative to the upper blade portion, the blade segments of the bottom blade portion forming one or more blade segment sets, each blade segment set having at least two of the blade segments that are pivotally jointed at a corresponding swivel interconnection, whereby, in operation, the bottom surface-engaging edges of the blade segments in a same blade segment set can tilt with reference to one another when following profile variations of the roadway surface, each blade segment being slidingly attached to a corresponding support frame member and the blade segment sets and the support frame members being equal in number.

12. A scraper blade device for cleaning a roadway surface, the scraper blade device having a front plow surface and a lowermost edge, the scraper blade device including:

an upper blade portion generally defining an upper area of the front plow surface of the scraper blade device; and a bottom blade portion generally defining a bottom area of the front plow surface of the scraper blade device, the bottom blade portion including a plurality of width-wise-disposed and juxtaposed blade segments, each blade segment including a bottom surface-engaging edge and the bottom surface-engaging edges of the blade segments forming together the lowermost edge of the scraper blade device, each blade segment being slidingly movable in an up and down movement relative to the upper blade portion, the blade segments of the bottom blade portion forming one or more blade segment sets, each blade segment set having at least two of the blade segments that are pivotally jointed at a corresponding swivel interconnection, whereby, in operation, the bottom surface-engaging edges of the blade segments in a same blade segment set can tilt with reference to one another when following profile variations of the roadway surface, each blade segment being slidingly attached to a corresponding support frame member, each support frame member being pivotally attached to the upper blade portion and can pivot around a pivot axis that is substantially parallel to the lowermost edge of the scraper blade device, each support frame member being biased towards a forward working position by at least one second bias mechanism.

13. The scraper blade device as defined in claim 12, wherein the at least one second bias mechanism includes an helical spring having a first end connected to the corresponding supporting frame member and a second end connected to the upper blade portion.

14. The scraper blade device as defined in claim 12, wherein each second bias mechanism is associated with only one of the supporting frame members.

15. The scraper blade device as defined in claim 12, wherein at least one of the support frame members is independently movable with reference to another one of the support frame members.

16. The scraper blade device as defined in claim 12, wherein the scraper blade device includes a plurality of juxtaposed moldboard sections attached together to form a unit, each moldboard section comprising a part of the upper blade portion and a part of the bottom blade portion, the part of the bottom blade portion comprising one of the blade segment sets and a corresponding one of the support frame members.

17. A scraper blade device for cleaning a roadway surface, the scraper blade device having a front plow surface and a lowermost edge, the scraper blade device including:

an upper blade portion generally defining an upper area of the front plow surface of the scraper blade device; and a bottom blade portion generally defining a bottom area of the front plow surface of the scraper blade device, the bottom blade portion including a plurality of width-wise-disposed and juxtaposed blade segments, each blade segment including a bottom surface-engaging edge and the bottom surface-engaging edges of the blade segments forming together the lowermost edge of the scraper blade device, each blade segment being slidingly movable in an up and down movement relative to the upper blade portion, the blade segments of the bottom blade portion forming one or more blade segment sets, each blade segment set having at least two of the blade segments that are pivotally jointed at a corresponding swivel interconnection located between corresponding lateral sides of the blade segments, whereby, in operation, the bottom surface-engaging edges of the blade segments in a same blade segment set can tilt with reference to one another when following profile variations of the roadway surface, the blade segment sets being more than two in number, each blade segment set having a marginal spacing between adjacent ones of the blade segments.

18. A scraper blade device for cleaning a roadway surface, the scraper blade device having a front plow surface and a lowermost edge, the scraper blade device including:

an upper blade portion generally defining an upper area of the front plow surface of the scraper blade device;

a bottom blade portion generally defining a bottom area of the front plow surface of the scraper blade device, the bottom blade portion including a plurality of width-wise-disposed and juxtaposed blade segments, each blade segment including a bottom surface-engaging edge and the bottom surface-engaging edges of the blade segments forming together the lowermost edge of the scraper blade device, each blade segment being slidingly movable in an up and down movement relative to the upper blade portion, the blade segments of the bottom blade portion forming one or more blade segment sets, each blade segment set having at least two of the blade segments that are pivotally jointed at a corresponding swivel interconnection located between corresponding lateral sides of the blade segments, whereby, in operation, the bottom surface-engaging edges of the blade segments in a same blade segment set can tilt with reference to one another when following profile variations of the roadway surface; and elastic means extending between at least two of the blade segments of the scraper blade device.

19. A scraper blade device for cleaning a roadway surface, the scraper blade device having a front plow surface and a lowermost edge, the scraper blade device including:

an upper blade portion generally defining an upper area of the front plow surface of the scraper blade device;

a bottom blade portion generally defining a bottom area of the front plow surface of the scraper blade device, the bottom blade portion including a plurality of width-wise-disposed and juxtaposed blade segments, each blade segment including a bottom surface-engaging edge and the bottom surface-engaging edges of the blade segments forming together the lowermost edge of the scraper blade device, each blade segment being slidingly movable in an up and down movement relative to the upper blade portion, the blade segments of the bottom blade portion forming one or more blade segment sets, each blade segment set having at least two of the blade segments that are pivotally jointed at a corresponding swivel interconnection located between corresponding lateral sides of the blade segments, whereby, in operation, the bottom surface-engaging edges of the blade segments in a same blade segment set can tilt with reference to one another when following profile variations of the roadway surface; and a cover plate extending in front of a bottom gap between two adjacent ones among the blade segments of the scraper blade device, the cover plate being attached to one of the two adjacent blade segments.

* * * * *